United States Patent [19]

Reynolds

[11] Patent Number: 4,565,439

[45] Date of Patent: Jan. 21, 1986

[54] LOW MASS HEAT AND PRESSURE FUSER

[75] Inventor: Scott D. Reynolds, Endwell, N.Y.

[73] Assignee: Xerox Corporation, Stamford, Conn.

[21] Appl. No.: 666,714

[22] Filed: Oct. 31, 1984

[51] Int. Cl.[4] ..... G03G 15/20

[52] U.S. Cl. ..... 355/3 FU; 355/14 FU; 219/216

[58] Field of Search ..... 355/3 FU, 14 FU, 3 BE, 355/16; 219/216

[56] References Cited

U.S. PATENT DOCUMENTS

| | | | |
|---|---|---|---|
| 4,095,886 | 6/1978 | Koeleman et al. | 355/3 FU |
| 4,279,496 | 7/1981 | Silverberg | 355/3 BE |
| 4,324,482 | 4/1982 | Szlucha | 355/3 FU |
| 4,348,102 | 9/1982 | Sessink | 355/3 FU X |
| 4,352,551 | 10/1982 | Iwao | 355/3 FU |
| 4,372,246 | 2/1983 | Azar et al. | 355/3 FU X |
| 4,378,152 | 3/1983 | Edwards et al. | 355/3 FU |
| 4,393,804 | 7/1983 | Nygard et al. | 355/3 FU X |
| 4,407,580 | 10/1983 | Hashimoto et al. | 355/3 BE X |
| 4,497,570 | 2/1985 | Bolte et al. | 355/3 BE X |

*Primary Examiner*—A. C. Prescott

[57] ABSTRACT

Heat and pressure fusing apparatus for fixing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing therethrough. The non-rotating mandrel is adapted to having its axis skewed relative to the axis of the pressure roll. A pair of edge sensors are provided for activating as mandrel skewing mechanism. Skewing of the mandrel by such mechanism effects proper belt tracking.

16 Claims, 5 Drawing Figures

LOW MASS HEAT AND PRESSURE FUSER

This invention relates to the art of forming powder images and, more particularly, to heat and pressure fuser apparatus for fusing such images to substrates.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention, which relates to rendering permanent powder or toner images, the latent electrostatic image may be formed by means other than by the exposure of an electrostatically charged photosensitive member to a light image of an original document. For example, the latent electrostatic image may be generated from information electronically stored or generated, and the digital information may be converted to alphanumeric images by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate by a fuser apparatus. To date, the use of simultaneous heat and contact pressure for fusing toner images has been the most widely accepted commercially. Heretofore, it has been necessary with the foregoing type of fuser to heat the fuser not only when images are being fused but also during standby when images are not being fused. This is because of the long delay that would be required to elevate the fuser to a proper operating temperature if the heat supply were turned off during standby, the long delay being due to the relatively large mass that has to be brought up to the fusing temperature. Such delays would not be tolerated by the user even though operating the fuser in such a manner would eliminate a substantial waste of energy. Along with this saving of energy, there would also be a reduction in heat loading to the environment.

Elimination of fuser standby power has been accomplished in prior art devices such as flash fusers and cold pressure fusers. Both of these types of fusers, however, exhibit other drawbacks. For example, cold pressure fusers exhibit poor quality images. Flash fuser create undesirable effluents and they work very poorly with colored toners, especially the lighter colored ones. Also, the optical density of flash fused images is unsatisfactory.

Accordingly, I have provided, as disclosed herein, a heat and pressure fuser that can be satisfactorily operated without the employment of standby power. To this end, my fuser comprises a low mass endless belt which is entrained about a pair of non-rotating mandrels. A pressure roll is supported for pressure engagement with an area of the belt and together with one of the mandrels provides the necessary pressure for fusing. The pressure roll also effects movement of the belt.

A heat source for elevating the temperature of the belt is operatively supported at a predetermined distance from the area of contact between the belt and pressure roll, the distance being such that the belt has sufficient time to rise to the proper fusing temperature prior to contacting the toner images. Thus, when copy substrates carrying toner images thereon pass through this area the images are subjected simultaneously to heat and pressure.

An important aspect of my invention resides in the manner in which the low mass endless belt is made to properly move in its endless path about the mandrels. During operation, as the belt moves in its endless path, it "walks" or moves toward one end of the mandrel. Thus, the non-rotating mandrel which cooperates with the aforementioned pressure roll to produce the desired fusing pressure is pivotally mounted so that its axis can be skewed relative to the axis of the pressure roll. A sensor detects the belt edge as the belt tracks to one side of the mandrels. An output signal from the sensor is used to effect skewing of the mandrel in a direction that causes the belt to track or move in the opposite direction. Once the belt has returned to the desired position on the mandrels the edge of the belt is no longer sensed as being improperly positioned by the sensor. This causes the skewing of the mandrel to be terminated. A bias spring then returns the mandrel to a non-skewed position.

Figure 1:
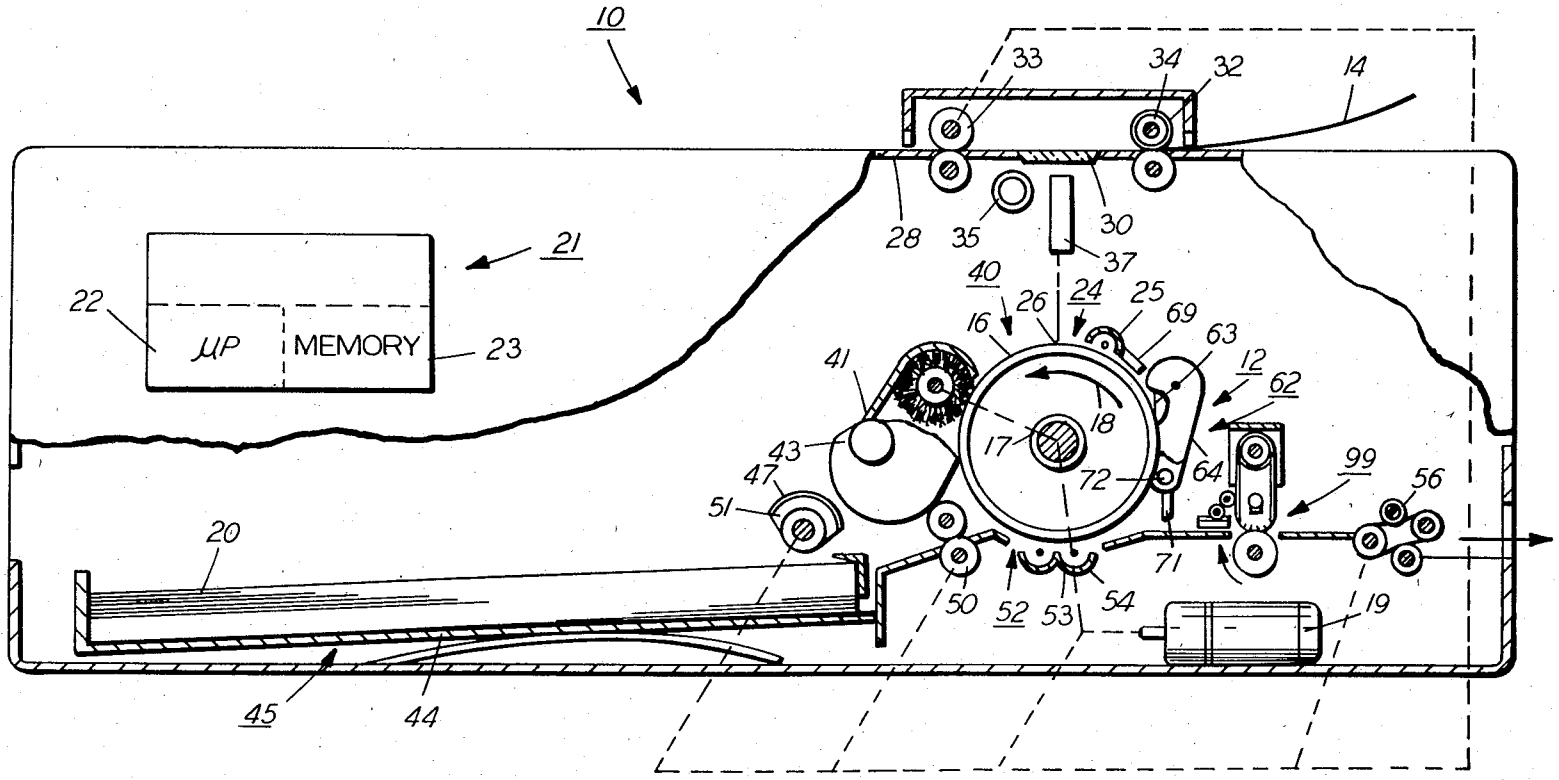
FIG. 1 is a side view depicting a xerographic reproduction machine or printer of the type adapted to incorporate the present invention.

Referring to FIG. 1 of the drawings, there is shown by way of example an automatic xerographic reproduction or printing machine, designated generally by the numeral 10 incorporating a fuser device 99 of the present invention.

The reproduction machine 10 depicted in FIG. 1 illustrates the various components utilized in machines of this type for producing copies of a document original 14. Although the device 99 of the present invention is particularly well adapted for use in reproduction machine 10, it should become evident from the following description that it is equally well suited for use in a wide variety of other reproduction and printing machine types and systems and is not necessarily limited in application to the particular embodiment of embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to ring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37, which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image of the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing elevation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet forward into the nip of a registration roll pair 50 which register the copy sheet with the image on the photoconductive surface 16 of photoreceptor 15. Registration roll pair 50 advance the copy sheet to transfer station 52. There, suitable transfer/-detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57 where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Figure 2:
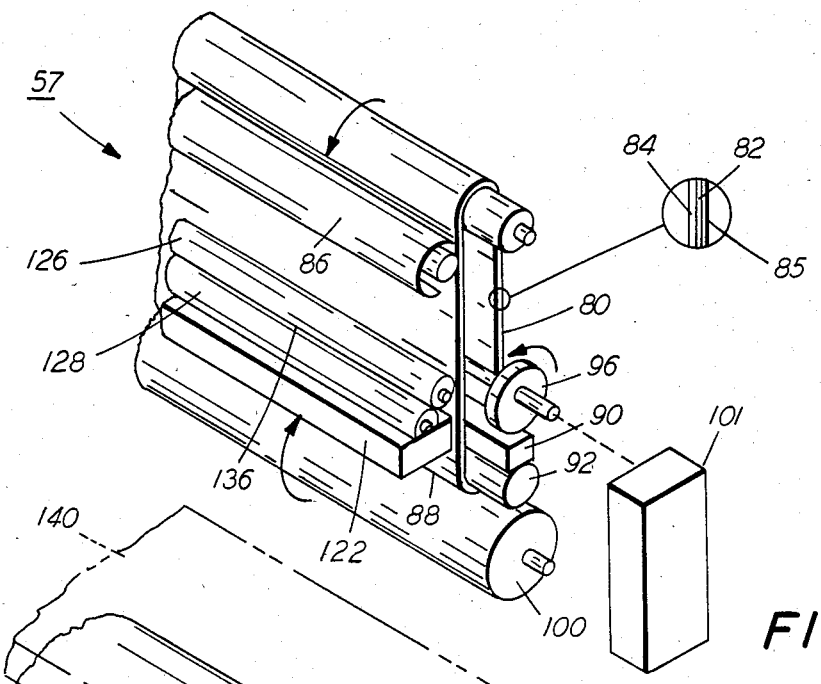
FIG. 2 is a perspective view of one embodiment of a fuser apparatus incorporating the inventive features of the invention.

Following transfer, residual developer remaining on the photoconductive surface 16 of photoreceptor 15 is removed at cleaning station 62 by means of cleaning blade 63 (FIG. 2). Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase device 69 is provided for this purpose.

At the cleaning station 62, the cleaning blade 63 is supported in contact with the photoreceptor 15 such that residual toner is chiselled therefrom.

The toner and debris that are removed from the photoreceptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 into a receptacle (not shown) which serves to store the residual toner until the receptacle is full after which it is removed from the machine.

Figure 3:
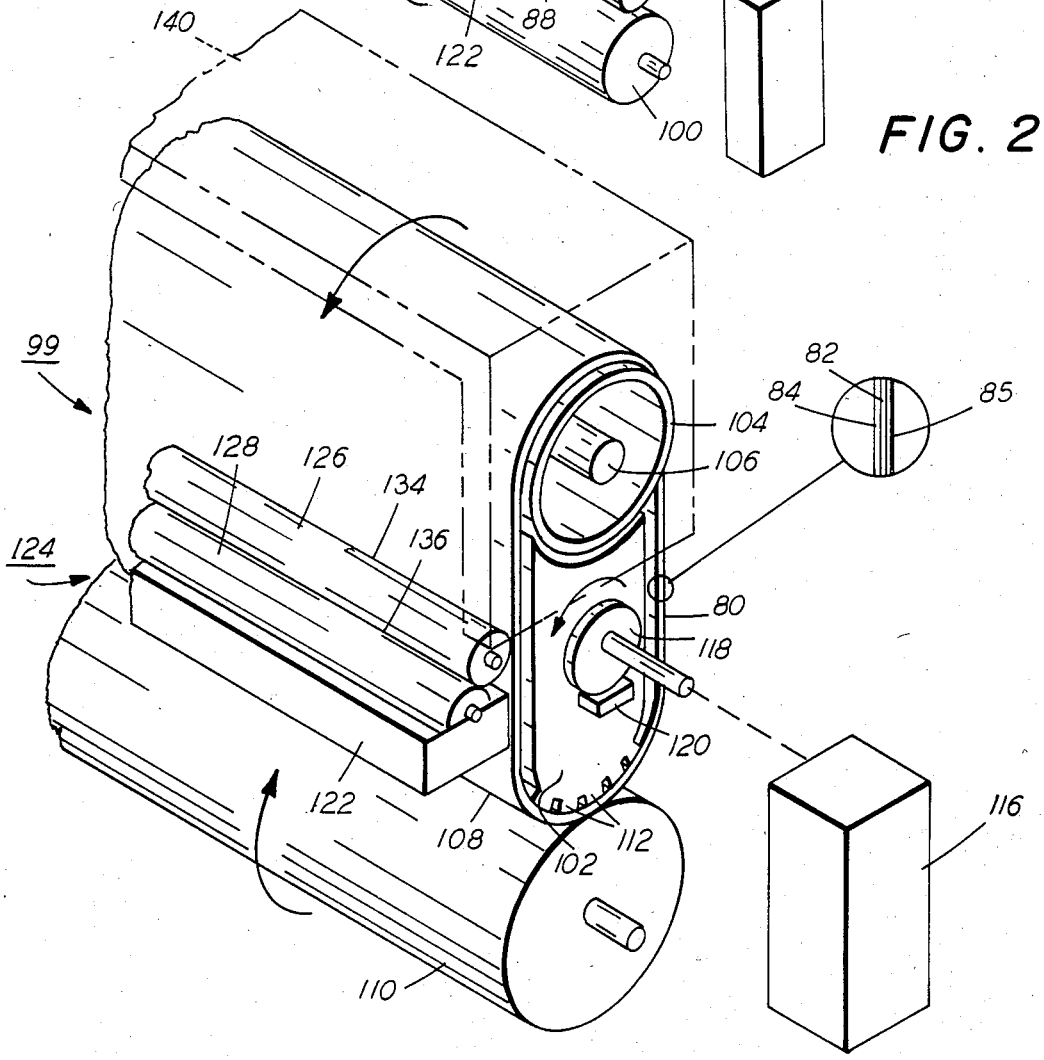
FIG. 3 is a perspective view of another embodiment of a fuser apparatus incorporating some of the features of the invention.

The inventive aspects of our invention will become apparent from a detailed discussion of FIGS. 2 and 3.

The fuser apparatus 57 disclosed in FIG. 2 comprises a relatively thin fuser belt structure 80 comprising a base member 82 preferably fabricated from a metal material which is sufficiently stiff to be dragged across a non-rotating mandrel. To this end, the base member is fabricated from nickel by a conventional electroforming process which provides a uniform thickness in the order of 2–3 mils. The outer surface of the base member is coated with a conformable layer 84 which preferably comprises silicone rubber. The inner surface of the base member 82 is preferably coated with a low friction material such as polytetrafluoroethylene commonly known by the tradename Teflon (registered trademark of E. I. DuPont). The thickness of the conformable layer is preferably at least 5 mils.

The belt structure is heated by a radiant heater 86 to a temperature suitable for fusing toner images carried by copy sheets 20, the belt making several revolutions in order to rise to the requird temperature. The radiant fuser 86 is positioned in a predetermined distance away from a nip area 88 through which the copy sheets pass with the conformable layer 84 contacting the toner images on the sheets. This distance between the nip area and the fuser is such that the heated portion of the belt contacts the toner images before the temperature of the belt has time to drop to a non-fusing temperature.

Because the belt structure is relatively thin it is incapable of creating adequate nip pressures for fusing by the simultaneous application of heat and pressure. Accordingly, there is provided a rigid pressure rod 90 for creating the required pressure in the nip area. The rod 90 is supported in engagement with one of the two mandrels 92 and 94 about which the belt is entrained. A suitable force applying device such as a cam structure 96 is provided for effecting pressure engagement of the rod 90 and the mandrel 92 which, in turn, cooperate with pressure roll 100 to create the desired pressure of the belt and toner images sandwiched between the mandrel 92 and the pressure roll. Alternatively, the cam structure 96 can be made to engage the non-rotating mandrel 92 thereby rendering the rod 90 unnecessary. The cam and follower arrangement is designed to apply a loading in the nip area 88 of approximately 200 pounds or 70–100 PSI. A suitable drive train represented schematically by the reference character 101 serves to drive the pressure roll 100 which, in turn, frictionally effects movement of the belt about the mandrels.

The belt structure 80 and radiant heater 86 form a low (i.e. less than 150 grams and preferably 80 grams) mass fuser which can be elevated to an operating level in 6–8 seconds while operating at fusing speeds from 10–12 in/sec or any other desired speed. For such operating conditions, the power rating of the radiant energy source 86 is in the order of 1500–2000 watts. The belt structure in its non-tensioned condition preferably has a diameter of 2½ inches and a width of 13 inches or greater.

Another embodiment 99 of the fuser apparatus disclosed in FIG. 3 comprises a fuser belt structure 80. The belt structure is entrained about a non-rotating mandrel 102 and a thin-walled, rotationally supported tube heater 104, the latter of which has an internal source of energy 106 for elevating the temperature of the belt. A nip 108 is formed between the belt surface and a pressure roll 110. The mandrel has appended thereto a plurality of insulating nubs 112 to minimize the heat loss from the belt. Rotation of the pressure roll in a manner similar to that for rotating conventional roll fusers causes the belt to move about the mandrel whereby a heated portion of the belt is brought into the nip for fusing in toner images. In this embodiment the belt structure 80, tube heater 104 and the internal heat source 106 form the low mass fuser.

The tube heater 104 is preferably fabricated from nickel and has a thickness of approximately four mils. The preferred method of forming the tube heater is by the electroforming process. Thus, a structure that is relatively rigid and substantially uniform in thickness is provided. Since the tube heater rotates, sliding friction between the belt structure and the tube heater is avoided when movement of the belt structure is effected by the pressure roll. The pressure roll in both embodiments of the invention has an outside diameter of three inches. The outer surface of the pressure roll is provided with a relatively thick conformable layer which may comprise silicone rubber. Bearings (not shown) support the tube heater for rotation by means of a drive schematically represented by reference character 116. The drive 116 also serves to actuate the cam 118 which engages a cam follower 120 for applying a load on the mandrel 102 for creating the desired pressure in the nip 108.

While the layer 84 tends to be abhesive, therefore, exhibits a low affinity for the toner material, it has been found desirable to coat the layer with a release agent material 121 contained in a sump 122. The material 121 comprises a polymeric release agent having functional groups such as carboxy, hydroxy, epoxy, ammo, isogenate, thioether or mercepto groups.

Figure 4:
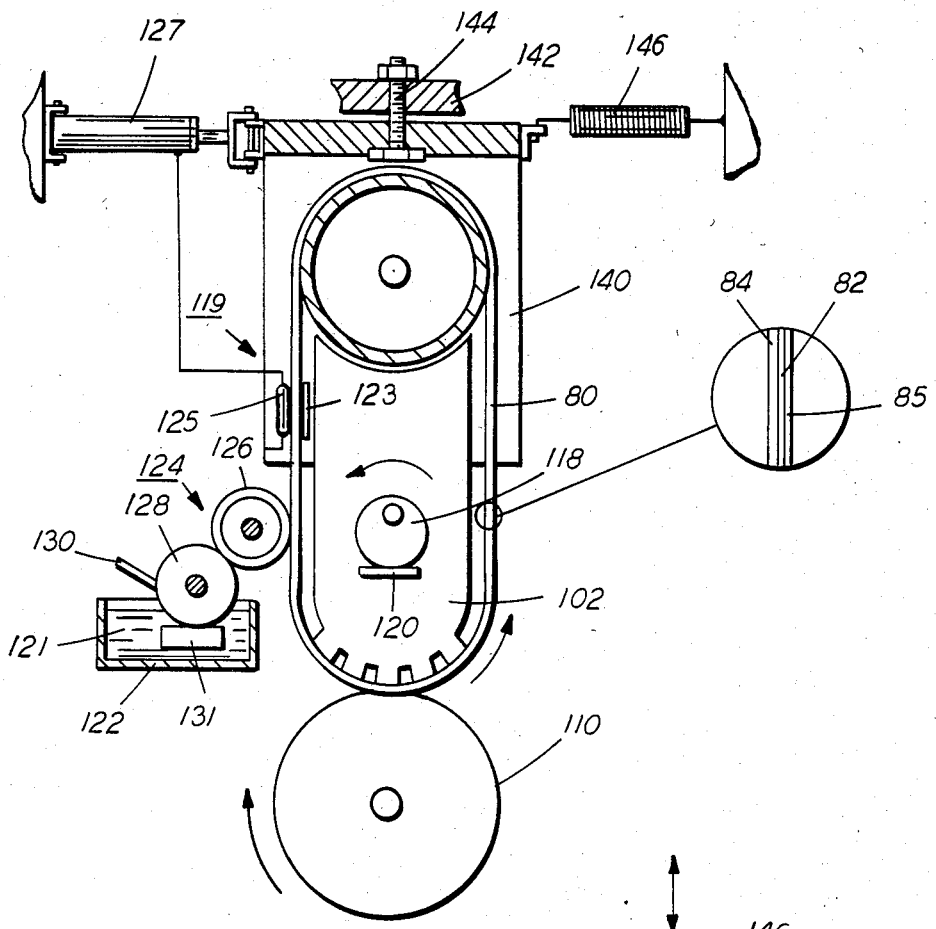
FIG. 4 is an end elevational view of the embodiment of FIG. 3.

For the purpose of coating the heated belt structure 80, there is provided a release agent management (RAM) system generally indicated 124 (FIG. 4). The mechanism 124 comprises a donor roll 126, metering roll 128, doctor blade 130, and a wick 131.

The metering roll 128 is partially immersed in the release agent material 121 and is supported for rotation such that it is contacted by the donor roll 126 which, in turn, is supported so as to be contacted by the heated belt structure 80. As can be seen, the orientation of the rolls is such as to provide a path for conveying material 121 from the sump to the surface of the heated belt structure 80. The metering roll is preferably a steel-surfaced roll having a 4–32 AA finish. The metering roll has an outside diameter of 0.75 inch. As mentioned above, the metering roll is supported for rotation, such rotation being derived by means of a positively driven heated belt structure 80 via the rotatably supported donor roll 126. In order to permit rotation (at a practical input torque to the heated belt structure 80) of the metering roll 128 in this manner the donor roll 126 comprises a deformable layer which forms a first nip 134 between the metering roll and the donor roll and a second nip 136 between the latter and the heated belt. The nips also permit satisfactory release agent transfer between the rolls and belt structure. Suitable nip lengths are 0.10 inch.

The wick 131 is fully immersed in the release agent and contacts the surface of the metering roll 128. The purpose of the wick is to provide an air seal which disturbs the air layer formed at the surface of the roll 128 during rotation thereof. If it were not for the function of the wick, the air layer would be coextensive with the surface of the roll immersed in the release agent thereby precluding contact beteen the metering roll and the release agent.

The doctor blade 130, preferably fabricated from Viton, is $\frac{3}{4}\times\frac{1}{8}$ inch cross section and has a length coextensive with the metering roll. The edge of the blade contacting the metering roll has a radius of 0.001–0.010 inch. The blade functions to meter the release agent picked up by the roll 128 to a predetermined thickness, such thickness being of such a magnitude as to result in several microliters of release agent consumption per copy.

The donor roll 126 has an outside diameter of 0.813 inch when the metering roll's outside diameter equals 0.75 inch. It will be appreciated that other dimensional combinations will yield satisfactory results. For example, 1.5 inch diameter rolls for the donor and metering rolls have been employed. The deformable layer of the donor roll preferably comprises silicone rubber. However, other materials may also be employed.

The two rolls 126 and 128 form a low mass release agent management system. To this end, the rolls are fabricated as thin-walled (i.e. approximately 5 mils) nickel material members by electroforming into the desired configuration. Accordingly, a low mass RAM system is provided which allows uniform release agent applications without contacting the belt structure with a large mass which would act as a heat sink.

As will be appreciated, movement of belt structure 80 about the non-rotating mandrel 102 causes the belt structure to track or move to one side. The non-rotating mandrel 102 is pivotally supported so that its axis can be skewed relative to the axis of the pressure roll 110. By pivoting or skewing the axis of the mandrel 102 the belt structure is caused to track or move in the opposite direction.

Figure 5:
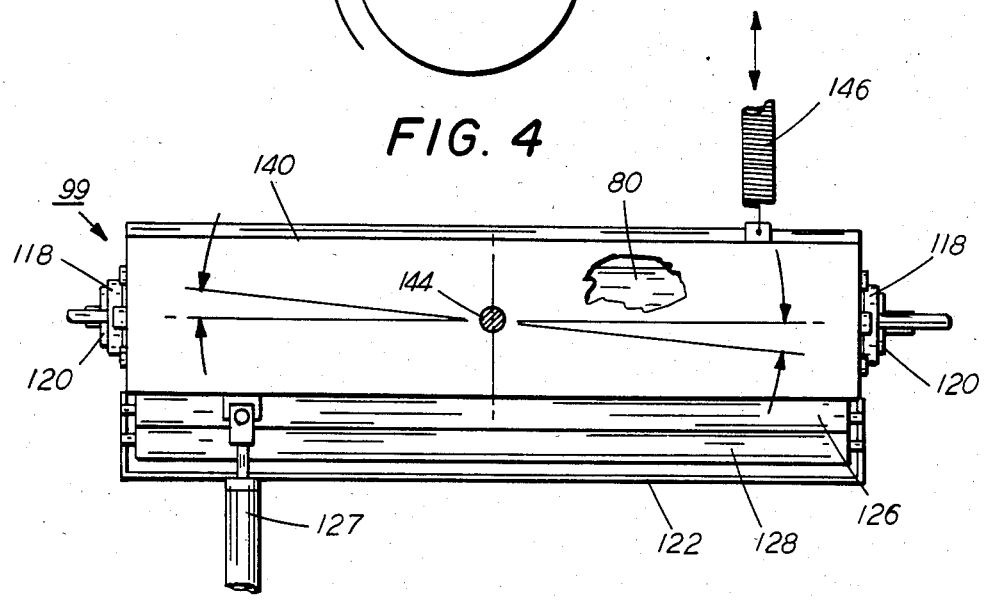
FIG. 5 is a sectional view taken on the lines IV—IV of FIG. 4.

In order to effect skewing of the mandrel 102 there is provided a non-contact interruptable magnetic sensor 119. The sensor comprises a magnet 123 and a conventional reed switch 125. The reed switch is operatively coupled to an electromechanical device such as a solenoid 127. The solenoid is attached to one end of a cradle 140 which supports the tube heater 104 and mandrel 102 such that the mandrel 102 can be skewed approximately five angular degrees clockwise as viewed in FIG. 5. To this end, the cradle 140 is rotatably supported by a frame member 142 and nut and bolt assembly 144 (see FIG. 4). A tension spring 146 provides for counterclockwise rotation of the mandrel 102 upon deenergization of the solenoid 127, the mandrel being returned to a non-skewed orientation relative to the pressure roll 110.

When the belt structure travels a sufficient distance in the one direction, the edge thereof interrupts the coupling of the magnetic flux of the magnet 123 with the reed switch 125 thereby causing actuation of the solenoid so as to produce skewing of mandrel 102. Conversely, when the magnetic flux is coupled to the reed switch the solenoid is deenergized and the mandrel 102 is returned by the bias spring 146 to its non-skewed position.

I claim:

1. Heat and pressure fuser apparatus for fixing toner images on substrates, said apparatus comprising:

belt structure adapted to contact toner images;

means including a non-rotating mandrel for supporting said belt structure;

means for effecting movement of said belt structure about said mandrel;

means cooperating with said non-rotating mandrel to exert pressure on said belt and toner images contacted by the belt structure; and means for effecting movement of said non-rotating mandrel thereby causing it to be skewed relative to the axis of said cooperating means whereby proper tracking of said belt as it moves about said belt supporting structure is accomplished.

2. Apparatus according to claim 1 wherein said means for effecting movement of said non-rotating mandrel comprises a pair of sensors which sense the pressure of the edges of said belt structure.

3. Apparatus according to claim 2 wherein said belt structure is relatively thin.

4. Apparatus according to claim 3 wherein said thin belt comprises electroformed nickel.

5. Apparatus according to claim 4 including a layer of conformable material adhered to the surface of said belt that contacts the toner images.

6. Apparatus according to claim 1 including temperature elevating means for said belt structure.

7. Apparatus according to claim 6 wherein said temperature elevating means comprises a rotating tube heater having an internal source of heat.

8. Apparatus according to claim 7 wherein said belt structure supporting means includes said rotating tube heater.

9. Printing apparatus comprises:

means for forming toner images on substrates, said apparatus comprising:

belt structure adapted to contact toner images;

means including a non-rotating mandrel for supporting said belt structure;

means for effecting movement of said belt structure about said mandrel;

means cooperating with said non-rotating mandrel to exert pressure on said belt and toner images contacted by the belt structure; and means for effecting movement of said non-rotating mandrel thereby causing it to be skewed relative to the axis of said cooperating means whereby proper tracking of said belt as it moves about said belt supporting structure is accomplished.

10. Apparatus according to claim 9 wherein said means for effecting movement of said non-rotating mandrel comprises a pair of sensors which sense the pressure of the edges of said belt structure.

11. Apparatus according to claim 10 wherein said belt structure is relatively thin.

12. Apparatus according to claim 11 wherein said thin belt comprises electroformed nickel.

13. Apparatus according to claim 12 including a layer of conformable material adhered to the surface of said belt that contacts the toner images.

14. Apparatus according to claim 13 including temperature elevating means for said belt structure.

15. Apparatus according to claim 14 wherein said temperature elevating means comprises a rotating tube heater having an internal source of heat.

16. Apparatus according to claim 15 wherein said belt structure supporting means includes said rotating tube heater.

* * * * *